US009480332B2

(12) United States Patent
Han

(10) Patent No.: US 9,480,332 B2
(45) Date of Patent: Nov. 1, 2016

(54) HEIGHT-ADJUSTABLE TABLE

(71) Applicant: SKE CO., LTD., Seoul (KR)

(72) Inventor: Moon Gyu Han, Seoul (KR)

(73) Assignee: SKE CO., LTD. (KR)

( * ) Notice: Subject to any disclaimer, the term of this patent is extended or adjusted under 35 U.S.C. 154(b) by 0 days.

(21) Appl. No.: 14/865,345

(22) Filed: Sep. 25, 2015

(65) Prior Publication Data

US 2016/0249737 A1 Sep. 1, 2016

(30) Foreign Application Priority Data

Feb. 27, 2015 (KR) ..... 10-2015-0028346

(51) Int. Cl.

| | |
|---|---|
| ***A47B 9/00*** | (2006.01) |
| ***A47B 9/16*** | (2006.01) |
| ***A47B 9/02*** | (2006.01) |
| ***A47B 9/14*** | (2006.01) |

(52) U.S. Cl.
CPC . *A47B 9/16* (2013.01); *A47B 9/02* (2013.01); *A47B 9/14* (2013.01)

(58) Field of Classification Search
CPC ..... A47B 3/02; A47B 2003/025
USPC ..... 108/116–120, 145, 147, 147.11
See application file for complete search history.

(56) References Cited

U.S. PATENT DOCUMENTS

| | | | | |
|---|---|---|---|---|
| 2,531,856 | A * | 11/1950 | Marcouiller | B62B 3/022 248/168 |
| 3,727,245 | A * | 4/1973 | Gerth | A47C 17/134 280/641 |
| 4,611,823 | A * | 9/1986 | Haas | F16M 11/42 108/119 |
| 5,447,319 | A * | 9/1995 | Huang | A47D 13/043 108/120 |
| 5,722,513 | A * | 3/1998 | Rowan | B66F 7/065 187/211 |
| 6,974,185 | B2 * | 12/2005 | Hsieh | A47C 3/36 108/117 |
| 8,016,305 | B2 * | 9/2011 | Cheng | A47D 13/043 280/87.051 |
| 8,544,391 | B2 * | 10/2013 | Knox | B60N 3/063 108/12 |
| 9,326,598 | B1 * | 5/2016 | West | A47B 3/02 |
| 2004/0040480 | A1 * | 3/2004 | Hwang | A47B 3/02 108/145 |

FOREIGN PATENT DOCUMENTS

| | | |
|---|---|---|
| JP | 2011041664 | 3/2011 |
| JP | 2013042887 | 3/2013 |
| KR | 200219992 | 4/2001 |
| KR | 100330661 | 3/2002 |
| KR | 200462462 | 9/2012 |

* cited by examiner

*Primary Examiner* — Matthew Ing

(74) *Attorney, Agent, or Firm* — Cantor Colburn LLP

(57) ABSTRACT

Provided is a height-adjustable table configured such that a height adjustment member rotates in response to an operation of an actuation unit, thereby being released from a locked state, and when an upper plate of the table is vertically lifted to a desired level, the operation of the actuation unit is stopped, and the height of the upper plate is adjusted step by step. Optimal space utility and a simple inner structure of the height-adjustable table can be accomplished, thereby reducing manufacturing cost and increasing user convenience.

7 Claims, 9 Drawing Sheets

HEIGHT-ADJUSTABLE TABLE

CROSS REFERENCE TO RELATED APPLICATION

The present application claims priority to Korean Patent Application No. 10-2015-0028346, filed Feb. 27, 2015, the entire contents of which is incorporated herein for all purposes by this reference.

BACKGROUND OF THE INVENTION

1 . Field of the Invention

The present invention generally relates to a height-adjustable table. More particularly, the present invention relates to a height-adjustable table configured such that a height adjustment member rotates in response to an operation of an actuation unit, thereby being released from a locked state, and when an upper plate of the table is vertically lifted to a desired level, the operation of the actuation unit is stopped, and the height of the upper plate is adjusted step by step. Accordingly, the present invention realizes the optimal space utility and a simple inner structure of the height-adjustable table, thereby reducing manufacturing cost and increasing user convenience.

2 . Description of the Related Art

Generally, a table is manufactured in various sizes and shapes according to its intended use. When manufacturing a table for children, the table is small and light, but when manufacturing a table for a home or an office, the table requires durable and robust for its use, and thus it is big and heavy.

The table is typically made up of an upper plate and a plurality of support legs, and when used, the table is used with the support legs spread, but when unused, the table is stored with the support legs folded.

However, the conventional table has a problem in that when the support legs of the table are spread from the upper plate, the table is fixed to a single predetermined height for use, and it is impossible to adjust the height of the upper plate, thus the utility of the table is low.

To address the issue, a table constructed in a folding manner to be conveniently used is on the market. When the upper plate of the folding table is lifted, the folded upper plate is lifted up diagonally while describing a parabola. Accordingly, the folding table has a problem in that it requires a larger space for use, and thus space utility is low.

In recent years, to solve the problem, a table height-adjustment device has been proposed as disclosed in Korean Patent No. 10-0330661.

The invention of the related art includes: first longitudinal guide holes provided at two opposite sides of an upper plate of a table; second longitudinal guide holes provided at sides of supporting plates securely placed inside supporting poles; folding links movably combined with the first and second longitudinal guide holes; a moving unit connected with lower pins to stretch the folding links; a threaded shaft moving the moving unit forward and backward within the range of the second longitudinal guide holes; and rotating means to rotate the threaded shaft. Accordingly, the table of the related art can adjust the height of the table unlike the existing tables, and thus it can be used conveniently and comfortably.

However, in the invention of the related art, if a decelerating motor or a handle is rotated to adjust the height of the table, the threaded shaft rotates to close or open the folding links, thereby lifting or lowering the upper plate. Accordingly, since the inner structure of the table of the related art is complex, the table is difficult to fabricate, thereby increasing manufacturing cost and often causing malfunctions.

The foregoing is intended merely to aid in the understanding of the background of the present invention, and is not intended to mean that the present invention falls within the purview of the related art that is already known to those skilled in the art.

3 . Documents of Related Art (Patent Document 1) Korean Patent No. 10-0330661.

SUMMARY OF THE INVENTION

Accordingly, the present invention has been made keeping in mind the above problems occurring in the related art, and the present invention is intended to propose a height-adjustable table configured in such a manner that a height adjustment member rotates in response to the operation of an actuation unit, thereby being released from a locked state, and when an upper plate is vertically lifted to a desired height, the operation of the actuation unit is stopped, and the height of the upper plate is adjusted step by step. Accordingly, the present invention realizes the optimal space utility and simple inner structure of the height-adjustable table, thereby reducing manufacturing cost and increasing user convenience.

In order to achieve the above object, according to one aspect of the present invention, there is provided a height-adjustable table including:

an upper plate;

a leg unit mounted to a lower surface of the upper plate and having a lifting unit provided in such a manner that when an actuation unit is operated, the lifting unit is lifted or lowered while a locking protrusion of the lifting unit is locked in one of a plurality of height adjustment holes of a height adjustment member;

the actuation unit including:

an actuation lever rotatably combined with a fixed mount to rotate based on a shaft pin, the fixed mount being fixed to the lower surface of the upper plate; and a pressure member pressurizing a height adjustment unit while the actuation lever is operated, wherein when the actuation lever is operated, the locking protrusion of the leg unit is released from or locked in one of the height adjustment holes of the height adjustment member while the pressure member applies a pressure to the height adjustment member or removes the pressure therefrom; and the height adjustment unit provided in such a manner that while the actuation unit is operated, the locking protrusion is released from or locked in one of the height adjustment holes to progressively adjust the height of the leg unit while the height adjustment member rotates based on a shaft thereof, the height adjustment unit being combined with an inner side of an upper bracket of the leg unit.

The present invention has an advantage in that the height adjustment member rotates in response to the operation of the actuation unit of the present invention, thereby being released from a locked state, and when the upper plate is vertically lifted to a desired height, the operation of the actuation unit is stopped, and the height of the upper plate is adjusted step by step. Accordingly, the present invention realizes optimal space utility and a simple inner structure of the height-adjustable table, thereby reducing manufacturing cost and increasing users' convenience.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION OF THE INVENTION

Figure 1:
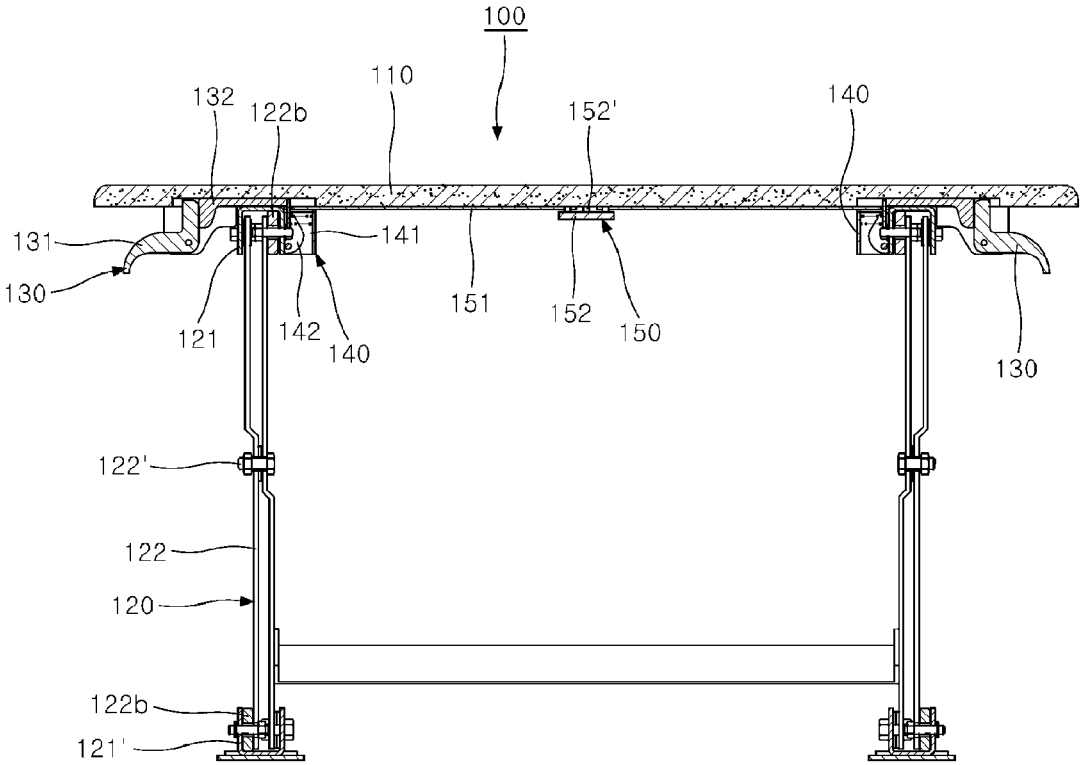
FIG. 1 is a front sectional view of the present invention.

Hereinbelow, an exemplary embodiment of the present invention will be described in detail with reference to the accompanying drawings. Throughout the drawings, the same reference numerals will refer to the same or like parts.

The height-adjustable table 100 of the present invention includes: an upper plate 110; a leg unit 120 mounted to a lower surface of the upper plate 110 and having a lifting unit 122 provided in such a manner that when an actuation unit 130 is operated, the lifting unit 122 is lifted or lowered while a locking protrusion 122*b*' of the lifting unit 122 is engaged with one of a plurality of height adjustment holes 142*c* of a height adjustment member 142; the actuation unit 130 including: an actuation lever 131 rotatably combined with a fixed mount 131*a* to rotate based on a shaft pin 131*b*, the fixed mount 131*a* being fixed to the lower surface of the upper plate 110; and a pressure member 132 pressurizing a height adjustment unit 140 while the actuation lever 131 is operated, wherein when the actuation lever 131 is operated, the locking protrusion 122*b*' of the leg unit 120 is released from or engaged with one of the height adjustment holes 142*c* of the height adjustment member 142 while the pressure member 132 applies a pressure to the height adjustment member 142 or removes the pressure therefrom; and the height adjustment unit 140 provided in such a manner that while the actuation unit 130 is operated, the locking protrusion 122*b*' is released from or locked in one of the height adjustment holes 142*c* to progressively adjust the height of the leg unit 120 while the height adjustment member 142 rotates based on a shaft 142*a*' thereof, the height adjustment unit 140 being combined with an inner side of an upper bracket 121 of the leg unit 120. The above description will be described in more detail.

In the height-adjustable table 100, the leg unit 120 includes: upper and lower brackets 121 and 121' each having a longitudinal guide hole 121*a* with which the lifting unit 122 is combined, the upper and lower brackets 121 and 121' being fixed at locations under the upper plate 110; the lifting unit 122 including a plurality of lifting members mounted to the upper and lower brackets 121 and 121' in a scissor type, wherein a first end of each of the lifting members is held by a rotation guide shaft 122*a*, and a second end thereof is combined with a guide roller 122*b* to guide a movement of the lifting member along the longitudinal guide hole 121*a*, the guide roller 122*b* having the locking protrusion 122*b*' protruding therefrom; and an elastic member 123 provided between the lifting members, thereby preventing the lifting unit 122 from being lowered too rapidly.

The elastic member 123 includes two springs having different diameters.

The leg unit 120 further includes: an auxiliary spring 124 provided to elastically lift or lower the lifting unit 122, the auxiliary spring 124 being combined with the rotation guide shaft 122*a* of the lifting unit 122.

The height adjustment unit 140 includes: a fixed member 141 fixed to the inner side of the upper bracket 121 of the leg unit 120; the height adjustment member 142 combined with the fixed member 141 and adjusting the height of the leg unit 120 while rotating based on the shaft 142*a*' thereof when the actuation unit 130 is operated; and a restoration member 143 provided between the fixed member 141 and the height adjustment member 142, and restoring the height adjustment member 142 to the initial position thereof.

The height adjustment member 142 includes: a height adjustment body 142*a* rotated based on the shaft 142*a*' of the height adjustment member 142 by the operation of the actuation unit 130; a pressure protrusion 142*b* provided on an upper part of the height adjustment body 142*a;* and the plurality of height adjustment holes 142*c* which are engaged with or released from the locking protrusion 122*b*' of the leg unit 120, the height adjustment holes 142*c* being provided on a lower part of the height adjustment body 142*a*.

The height-adjustable table 100 further includes: a cooperation unit 150 provided between and combined with the height adjustment units 140 placed at opposite sides of the table and configured such that the height adjustment units 140 are operated simultaneously while the cooperation unit 150 cooperates with the pressure of the pressure member 132.

The cooperation unit 150 includes: a cooperation guide member 152 rotating based on a central shaft 152' thereof; and cooperation members 151 connected with two opposite ends of the cooperation guide member 152, respectively, the cooperation members 151 cooperating with the cooperation guide member while rotating based on the cooperation guide member 152 when the actuation unit 130 is operated, the cooperation members 151 having respective combination notches 151' combined with the pressure protrusions 142*b* provided in the height adjustment units 140.

The fabrication process of the exemplary embodiment of the present invention constructed above will be described in detail below.

Figure 2:
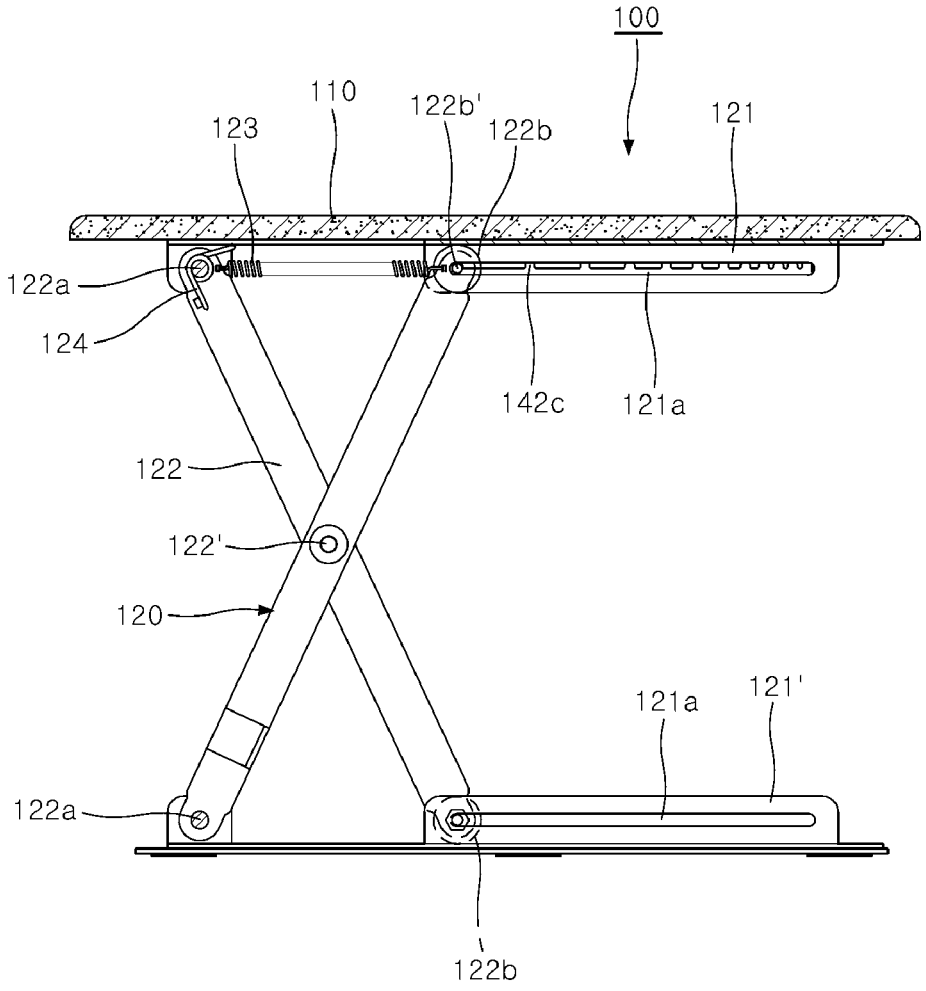
FIG. 2 is a side sectional view of the present invention.
Figure 3:
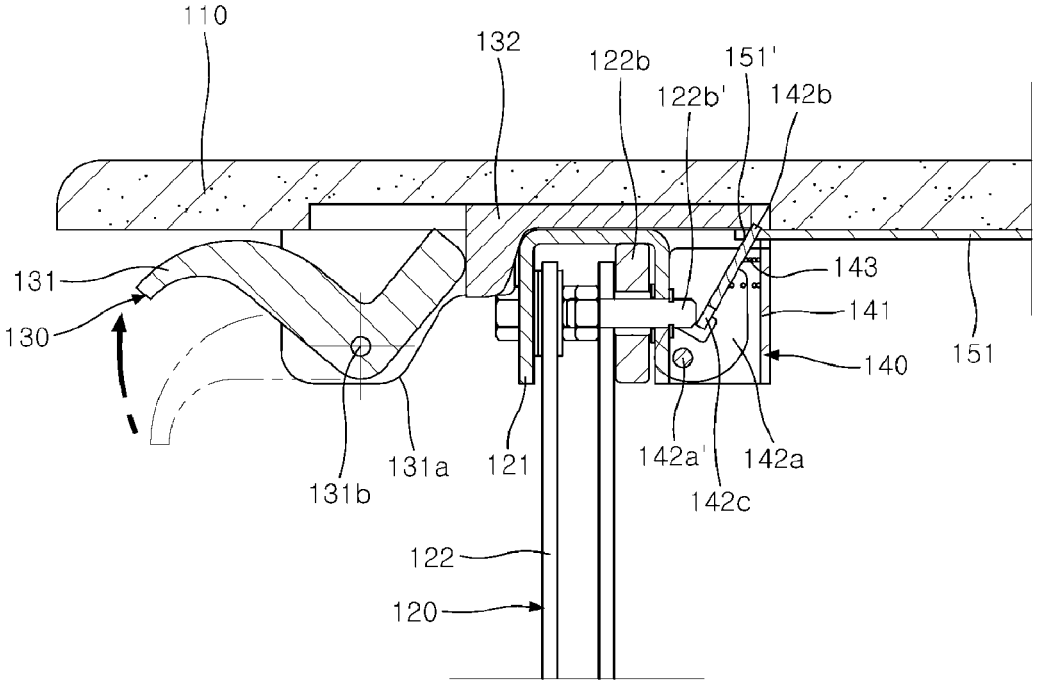
FIGS. 3 to 7 are views showing the operation of the present invention.
Figure 4:
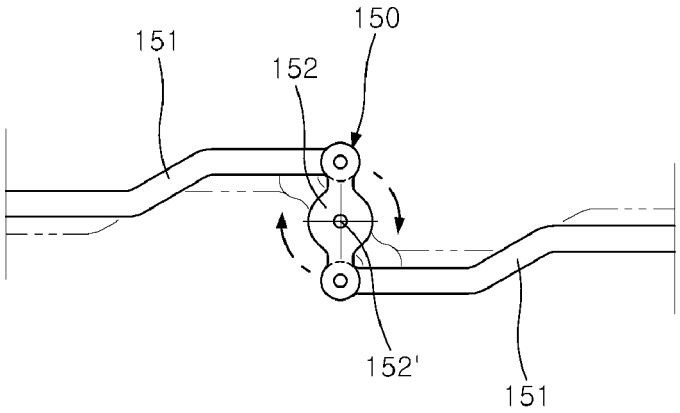
Figure 5:
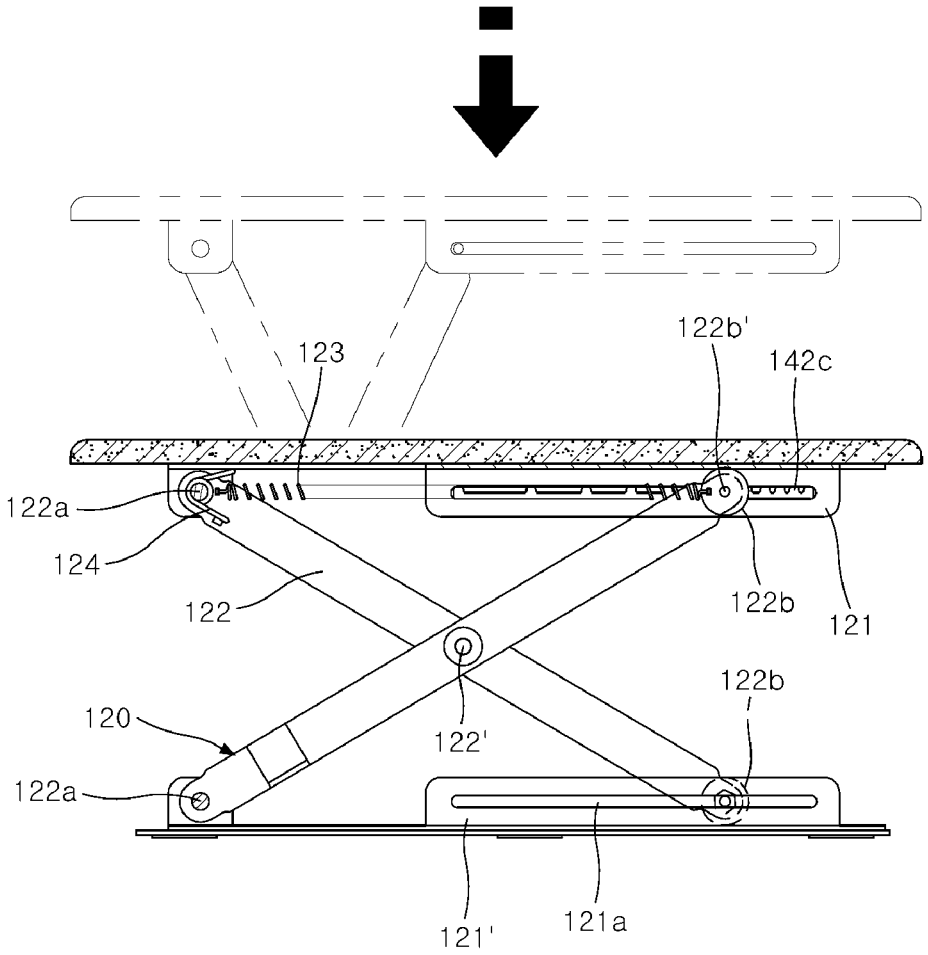
Figure 6:
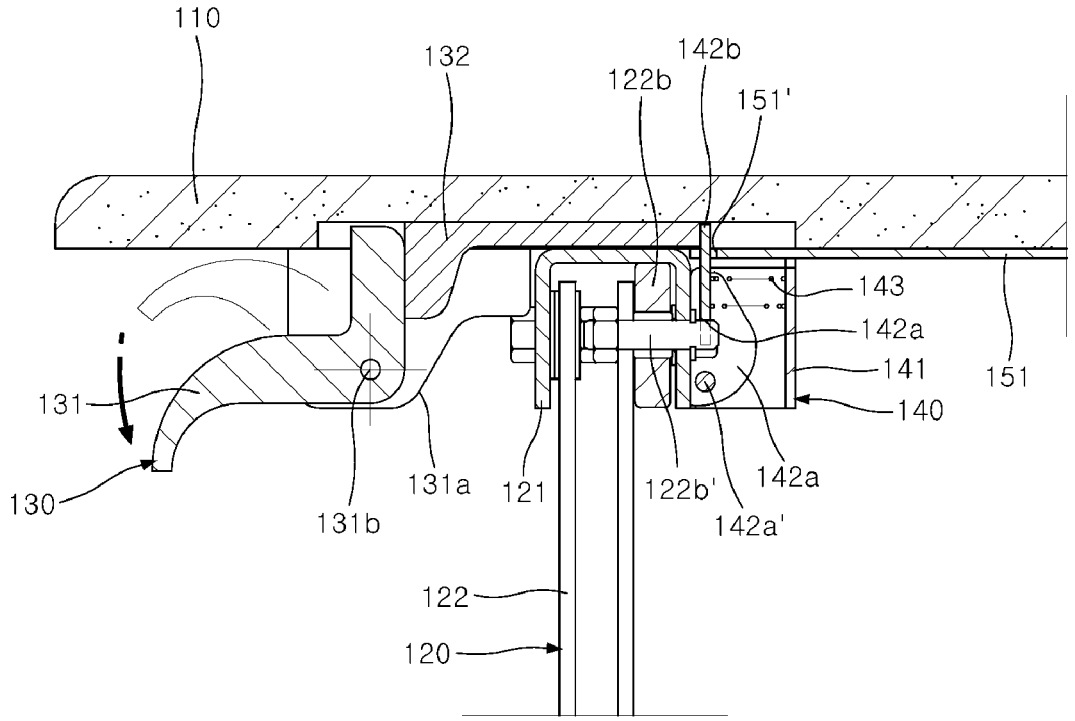
Figure 7:
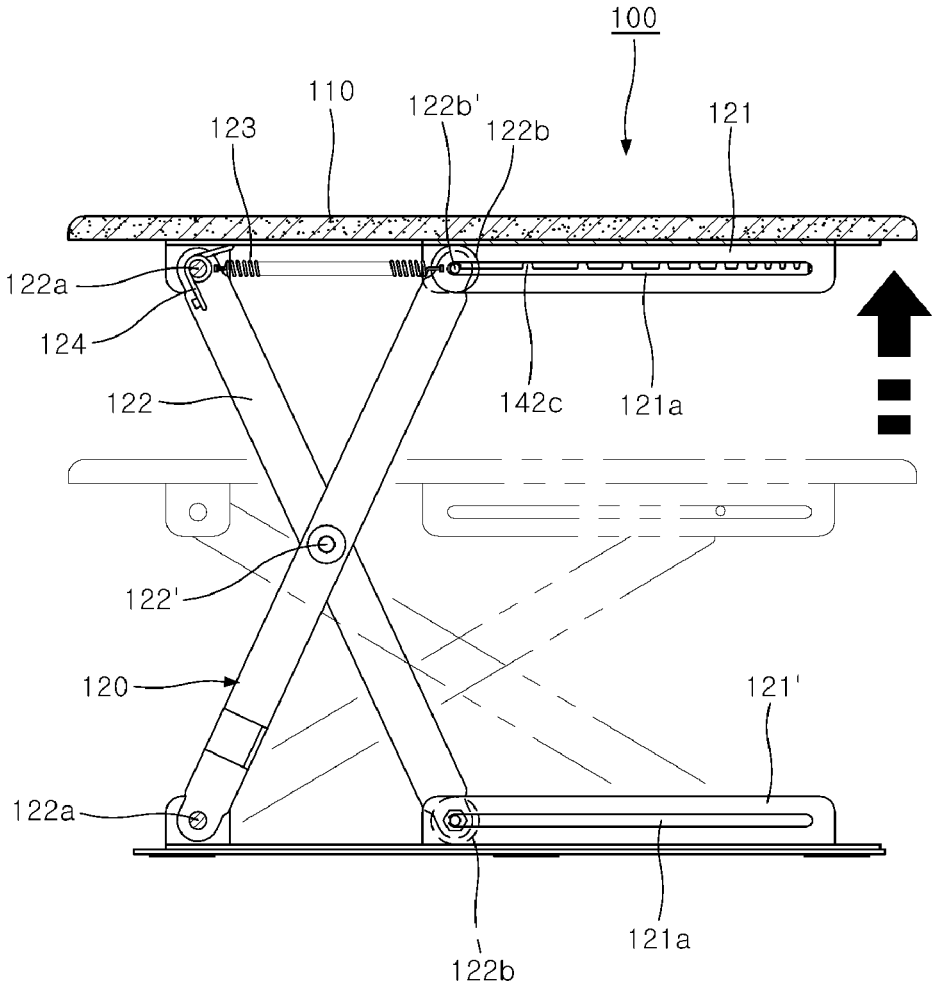

First, the upper plate 110 made of wood and formed to be flat as illustrated in FIGS. 1 and 2 is turned over so that the lower surface of the upper plate 110 faces upward.

After the upper brackets 121 are arranged at opposite positions spaced at a predetermined distance on the lower surface of the upper plate 110 and are mounted thereto, while the fixed mount 131*a* is fixed to be adjacent to the outside of each of the upper brackets 121, the actuation lever 131 is combined with the fixed mount 131*a* by using the shaft pin 131*b* so that the actuation lever 131 can rotate.

The pressure member 132 pressurizing the height adjustment member 142 is mounted to be in close contact with the inner surface of the actuation lever 131.

In addition, the fixed member 141 of each of the height adjustment units 140 is fixed to the inner side of each of the upper brackets 121, and the height adjustment member 142 having the height adjustment holes 142*c* is located between the upper bracket 121 and the fixed member 141, and then the shaft 142*a*' of the height adjustment member 142 is combined with the height adjustment member 142 toward the side of the height adjustment member 142 from the outside of the fixed member 141 so that the height adjustment member 142 can rotate.

In this case, the pressure member 132 of the actuation unit 130 is in close contact with the pressure protrusion 142*b* of the height adjustment member 142 so that when the pressure member 132 is pressurized, the height adjustment member 142 can rotate.

The restoration member 143 is mounted between the fixed member 141 and the height adjustment member 142, wherein the first end of the restoration member 143 is mounted to one side of the height adjustment member 142 and the second end thereof is mounted to the inner surface of the fixed member 141.

As described above, when the fabrication of the height adjustment units 140 is completed, the cooperation unit 150 simultaneously operating the height adjustment units 140 during the operation of the actuation unit 130 is provided between and combined with the height adjustment units 140. After the combination notches 151' formed on the cooperation members 151 of the cooperation unit 150 are combined with the pressure protrusions 142*b* of the height adjustment members 142, opposing ends of the cooperation members 151 are connected with respective opposite ends of the cooperation guide member 152.

The cooperation guide member 152 is mounted to rotate based on the central shaft 152' thereof located between the height adjustment units 140.

Additionally, a first end of each of the lifting members provided in a scissor type is held to the upper and lower brackets 121 and 121' by the rotation guide shaft 122*a* so that the lifting members can rotate, and the guide roller 122*b* is mounted to a second end of each of the lifting members to be guided in rolling contact with the inner surfaces of the upper and lower brackets 121 and 121'. The locking protrusion 122*b'* of the guide roller 122*b* is provided protruding toward the side of the longitudinal guide hole 121*a* to be combined with one of the height adjustment holes 142*c* of the height adjustment members 142.

The elastic member 123 including a spring provided under the upper plate 110 and between the lifting members is connected with the lifting members to prevent the lifting unit 122 from being lowered too rapidly and to lift the lifting unit 122 elastically when the lifting members are lifted.

In the elastic member 123, the spring is a double spring in which a small diameter spring is inserted into a large diameter spring, and the elastic member 123 prevents the lifting unit 122 from being lifted and lowered too rapidly.

Furthermore, the auxiliary spring 124 is mounted to the rotation guide shaft 122*a* of the lifting unit 122 to help the lifting or lowering motion of the lifting unit 122.

The operation of the exemplary embodiment of the present invention constructed as described above will be described in detail below.

First, as illustrated FIGS. 3 to 7, when it is required to lift a folded table to a predetermined height by closing the leg units 120, a user holds and presses at least one of the actuation levers 131 of the actuation units 130.

If the actuation lever 131 rotates based on the shaft pin 131*b* thereof, the pressure member 132 positioned at one end of the actuation lever 131 pressurizes one surface of the pressure protrusion 142*b* of the height adjustment member 142.

Then, the height adjustment member 142 is rotated based on the shaft 142*a'*, and the cooperation members 151 of the cooperation unit 150 combined with the pressure protrusions 142*b* of the two height adjustment units 140 provided at opposite sides of the table rotate based on the cooperation guide member 152 to simultaneously rotate the height adjustment members 142.

In this case, the locking protrusion 122*b'* of the lifting unit 122 locked in one of the height adjustment holes 142*c* is released therefrom.

When the locking protrusion 122*b'* is released from the height adjustment hole 142*c* of the height adjustment member 142 as described above, the user vertically lifts the upper plate 110 to the predetermined height while holding the actuation lever 131 of the actuation unit 130.

When the upper plate 110 is lifted, the lifting members of the lifting unit 122 rotate based on a rotation shaft 122', and the guide rollers 122*b* move in rolling contact with the upper and lower brackets 121 and 121'. During the movement of the rollers 122*b*, the locking protrusions 122*b'* of the guide rollers 122*b* are simultaneously guided along the longitudinal guide holes 121*a*.

In this case, the movement of the locking protrusion 122*b'* is not interrupted from the height adjustment hole 142*c* of the height adjustment member 142.

When the upper plate 110 reaches a desired height, the user removes the pressure from the actuation lever 131.

When the pressure of the actuation lever 131 is removed, the height adjustment member 142 rotates based on the shaft 142*a'* by the elasticity of the restoration member 143 mounted between the height adjustment member 142 and the fixed member 141, thereby restoring the position of the height adjustment member 142 to the initial position thereof. At the same time, the locking protrusion 122*b'* of the lifting unit 122 is locked in one of the height adjustment holes 142*c* of the height adjustment member 142, thereby realizing adjustment of the height of the leg unit 120.

In this case, when the height adjustment member 142 rotates, the pressure member 132 pressurizing the pressure protrusion 142*b* is moved toward the actuation lever 131 by the restoring force of the height adjustment member 142, thereby rotating the actuation lever 131 to the initial position thereof.

In addition, the cooperation members 151 combined with the pressure protrusions 142*b* of the height adjustment members 142 provided at the opposite sides of the table rotate based on the central shaft 152' of the cooperation guide member 152, thereby restoring the position of the cooperation member 151 to the initial position thereof.

To lift the height of the upper plate 110 higher after adjusting the height of the upper plate 110 as described above, the same process described above may be applied to adjust the height of the upper plate 110.

Accordingly, as described above, the upper plate 110 is vertically lifted to progressively adjust the height thereof.

Figure 8:
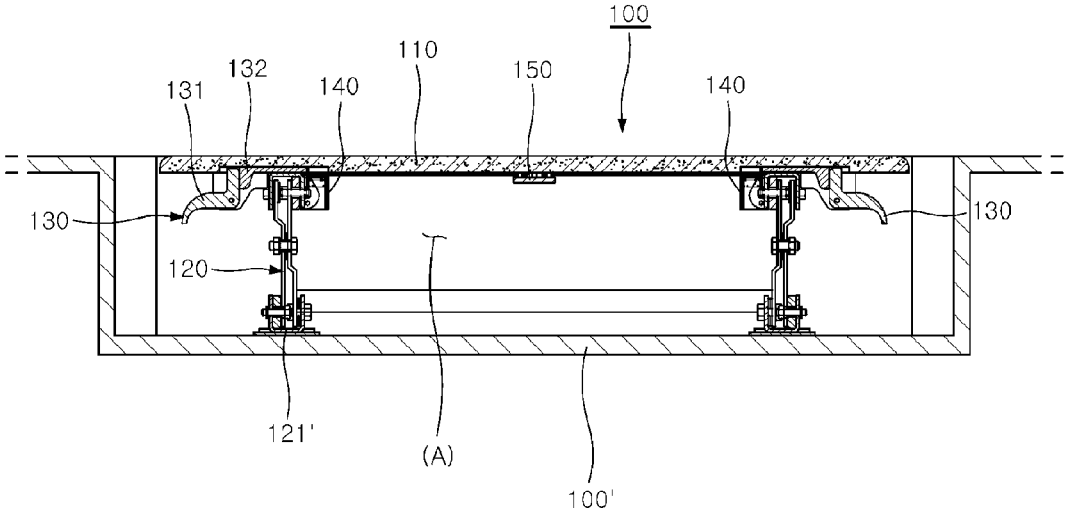
FIGS. 8 and 9 are views showing the use of a table put in a table receiving space.
Figure 9:
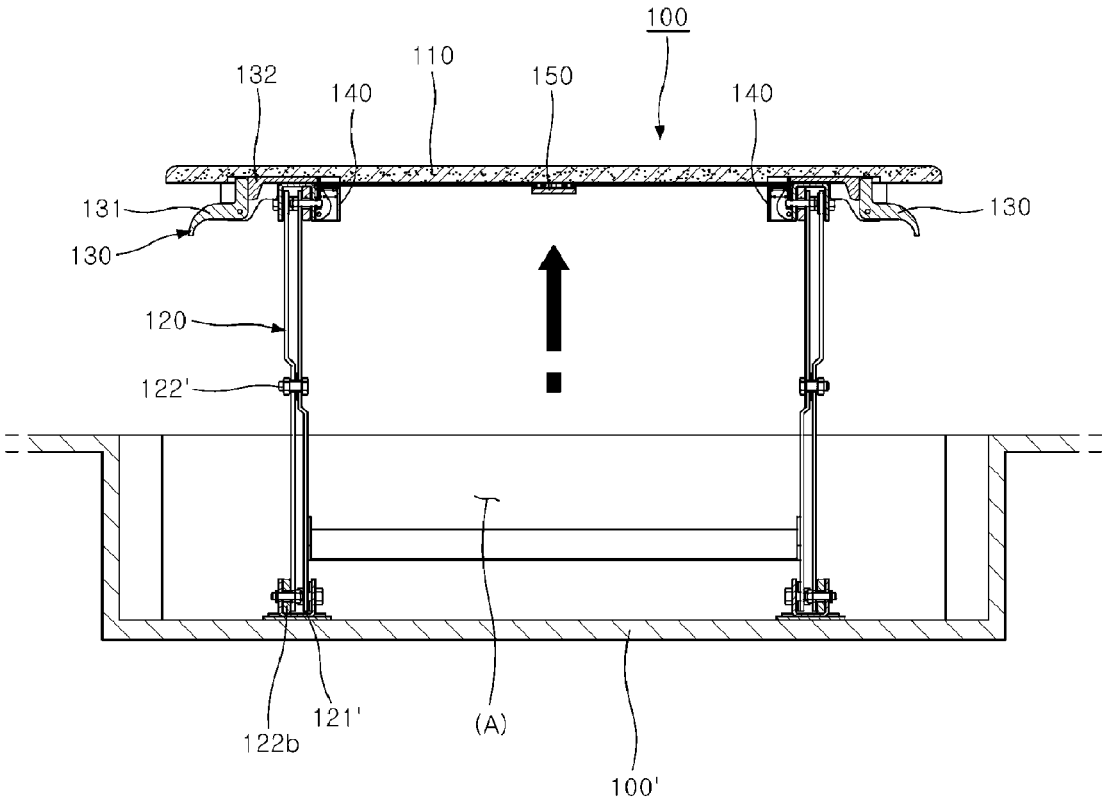

In addition, as illustrated in FIGS. 8 and 9, the height-adjustable table 100 having the above-mentioned construction may be used while being put in a table 100' having a receiving space A.

Here, the height of the upper surface of the height-adjustable table 100 is equal to the height of the table 100' having the receiving space A, so the height-adjustable table 100 put in the table 100' may be used as a normal table. When it is required to lift the upper plate 110 of the height-adjustable table 100 to a predetermined level, the upper plate 110 may be lifted to the desired height by operating the actuation unit 130 in the same manner as described above.

All terms or words used in the specification and claims have the same meaning as commonly understood by one of ordinary skill in the art to which inventive concepts belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Although a preferred embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A height-adjustable table comprising:

an upper plate;

an upper bracket mounted to a lower surface of the upper plate;

a leg unit mounted to the upper bracket and having a lifting unit, the lifting unit including a locking protrusion;

a height adjustment unit, wherein the height adjustment unit comprises: a fixed member fixed to an inner side of the upper bracket; a height adjustment member combined with the fixed member and having a plurality of height adjustment holes formed along the height adjustment member; and a restoration member provided between the fixed member and the height adjustment member and configured to restore the height adjustment member to an initial position thereof; and an actuation unit mounted to the lower surface of the upper plate, wherein the actuation unit includes: an actuation lever rotatably combined with a shaft pin of a fixed mount, the fixed mount being fixed to the lower surface of the upper plate; and a pressure member configured to pressurize the height adjustment unit by operation of the actuation lever, wherein the locking protrusion of the lifting unit is configured to be released from or locked in one of the height adjustment holes of the height adjustment member to adjust a height of the let unit.

2. The height-adjustable table of claim 1, further comprising: a lower bracket disposed opposite to the upper bracket, wherein the upper and lower brackets each having a longitudinal guide hole with which the lifting unit is combined, wherein the lifting unit includes two lifting members mounted between the upper and lower brackets in a scissor type, wherein a first end of each of the two lifting members is held by a rotation guide shaft, and a second end thereof is combined with a guide roller to guide a movement of the two lifting members along the longitudinal guide holes, the guide roller having the locking protrusion protruding therefrom, and an elastic member is provided between the two lifting members, thereby preventing the lifting unit from being lowered rapidly.

3. The height-adjustable table of claim 2, wherein the elastic member comprises two springs having different diameters.

4. The height-adjustable table of claim 2, further comprising:

an auxiliary spring provided to elastically lift or lower the lifting unit, the auxiliary spring being combined with the rotation guide shaft of the lifting unit.

5. The height-adjustable table of claim 1, wherein the height adjustment member comprises:

a height adjustment body rotated by the operation of the actuation unit;

a pressure protrusion provided on an upper part of the height adjustment body; and the plurality of height adjustment holes to which the locking protrusion is locked in or released from, the height adjustment holes being provided on a lower part of the height adjustment body.

6. The height-adjustable table of claim 1, further comprising:

a cooperation unit provided between the height adjustment unit and a neighboring height adjustment unit placed at opposite side of the table and configured such that the height adjustment unit and the neighboring height adjustment unit are operated simultaneously.

7. The height-adjustable table of claim 6, wherein the cooperation unit comprises:

a cooperation guide member rotating based on a central shaft thereof; and cooperation members connected to opposite ends of the cooperation guide member, respectively, the cooperation members cooperating with the cooperation guide member while rotating based on the cooperation guide member when the actuation unit is operated, the cooperation members having respective combination notches combined with the pressure protrusions provided in the height adjustment units.

* * * * *